US008911069B1

(12) United States Patent
Novak et al.

(10) Patent No.: US 8,911,069 B1
(45) Date of Patent: Dec. 16, 2014

(54) INK CARTRIDGE SOURCE IDENTIFICATION DETERMINATION

(71) Applicant: Hewlett-Packard Development Company, L.P., Houston, TX (US)

(72) Inventors: David B Novak, Corvallis, OR (US); Erik D. Ness, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 13/922,757

(22) Filed: Jun. 20, 2013

(51) Int. Cl.
*B41J 2/175* (2006.01)

(52) U.S. Cl.
CPC ..... *B41J 2/17543* (2013.01)
USPC ..... 347/86; 347/5; 347/85

(58) Field of Classification Search
USPC ..... 347/84–86, 5
See application file for complete search history.

(56) References Cited

U.S. PATENT DOCUMENTS

| | | | | |
|---|---|---|---|---|
| 6,345,891 | B1 | 2/2002 | Childers et al. | |
| 6,502,916 | B1 * | 1/2003 | Naka | 347/14 |
| 2002/0022990 | A1 * | 2/2002 | Kurata et al. | 705/14 |
| 2002/0140755 | A1 * | 10/2002 | Hetzer et al. | 347/17 |
| 2003/0063311 | A1 * | 4/2003 | Covitt et al. | 358/1.15 |
| 2003/0098902 | A1 * | 5/2003 | Shinada et al. | 347/86 |
| 2006/0092210 | A1 * | 5/2006 | Maniam et al. | 347/19 |
| 2006/0288889 | A1 | 12/2006 | Iwamoto | |

* cited by examiner

*Primary Examiner* — Julian Huffman
*Assistant Examiner* — Sharon A Polk
(74) *Attorney, Agent, or Firm* — Hewlett-Packard Patent Department

(57) ABSTRACT

A supply source indicator indicates whether an ink cartridge is received from a subscriber source. An ink order identifier indicates a combination of ink colors for different chambers in a color pen of a printer. When print data is received, the supply source indicator and the ink order identifier are accessed to determine whether the ink cartridge is received from a subscriber source.

19 Claims, 3 Drawing Sheets

| | 210 INK ORDER ID BITS | | | 220 COLOR ORDER | 230 SPECIAL SUPPLY SOURCE? | 240 FIRMWARE STATUS |
|---|---|---|---|---|---|---|
| 250 | 0 | 0 | 0 | CYM | N | REGULAR SUPPLY |
| 255 | 0 | 0 | 1 | CMY | Y | SPECIAL SUPPLY |
| 260 | 0 | 1 | 0 | YMC | N | REGULAR SUPPLY |
| 265 | 0 | 1 | 1 | YCM | Y | SPECIAL SUPPLY |
| 270 | 1 | 0 | 0 | MYC | N | REGULAR SUPPLY |
| 275 | 1 | 0 | 1 | MCY | N | REGULAR SUPPLY |
| 280 | 1 | 1 | 0 | YCY | Y | SPECIAL SUPPLY |
| 285 | 1 | 1 | 1 | MCM | Y | SPECIAL SUPPLY |

*FIG. 2*

INK CARTRIDGE SOURCE IDENTIFICATION DETERMINATION

BACKGROUND

Ink jet printers that are used on a regular basis require a user to frequently replace ink cartridges. Usually, the printer will inform the user when an ink cartridge is to be replaced. A user may choose from a variety of options to purchase ink cartridges such as purchasing ink cartridges in bulk, or by registering for a subscription service or a corporate service. In a subscription service, a user may subscribe to a service that delivers ink cartridges when the printer is almost out of ink. In a corporate service, a user may receive a large number of ink cartridges directly from a wholesale supplier.

BRIEF DESCRIPTION OF THE DRAWINGS

The following detailed description references the drawings, wherein:

FIG. 2 is an example of identification bits for a color pen of a printer.

DETAILED DESCRIPTION

A user may subscribe to a corporate service to purchase ink at a contracted price that is lower than a retail price. Security measures are necessary to prevent users from using a special ink cartridge provided by the corporate service without a valid contract and printer authentication.

Examples disclosed herein address these issues by identifying a source from which an ink cartridge is received. A color pen of the ink cartridge includes different chambers, each of which is filled with a different ink color. Identification bits of the color pen include a supply source indicator and ink order identifier. The supply source indicator indicates a source that provided the ink cartridge. The source may be a corporate service, a retail outlet, or any other entity that may supply an ink cartridge to a user. The ink order identifier may be identification bits that are mapped to the chambers of the color pen to indicate an ink color for each chamber. Some combinations of chamber ink color orders are reserved for special ink cartridges (e.g., ink cartridges provided by a corporate service), and other combinations of chamber ink color orders are reserved for regular ink cartridges (e.g., ink cartridges purchased from a retail outlet).

When print data is received, the supply source indicator is accessed from the color pen identification bits to identify the source which provided the ink cartridge. If the supply source indicator does not indicate that the ink cartridge is a special ink cartridge, the print data is printed using a color pen with chambers having color orders that correspond to regular ink cartridges. If the supply source indicator indicates that the ink cartridge is a special ink cartridge, the ink order identifier may be accessed from the color pen identification bits to confirm whether the ink cartridge is actually a special ink cartridge. If the ink order identifier indicates that the ink cartridge is a special ink cartridge, the print data is printed using the ink order that is identified by the ink order identifier. If the ink order identifier does not indicate that the ink cartridge is a special ink cartridge, then the ink cartridge is treated as a regular cartridge. In an example subscribed printer that may be part of a corporate service and strictly intended for subscription cartridges, an error message may be issued to indicate that a non-subscribed ink cartridge is not compatible with the printer because it is not authorized for use with the printer as per the service contract.

Figure 1:
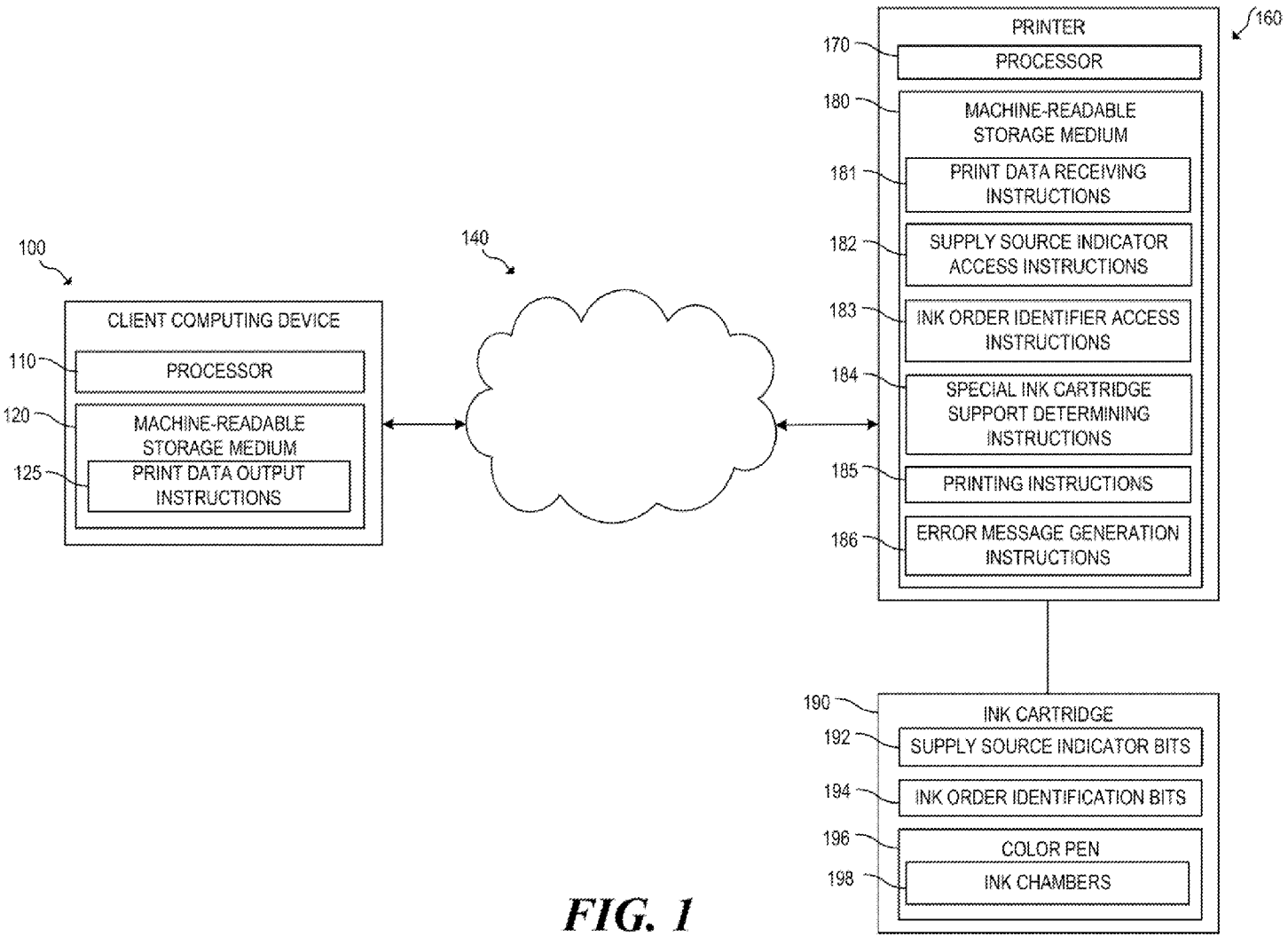
FIG. 1 is a block diagram of an example server computing device in communication via a network with a client computing device for identifying a source of an ink cartridge.

Referring now to the drawings, FIG. 1 is a block diagram of a printer 160 in communication via a network 140 with a client computing device 100. In some implementations, printer 160 may communicate directly with client computing device 100. As illustrated in FIG. 1 and described below, printer 160 may identify a source of an ink cartridge.

Printer 160 may be any printing device accessible to a client device, such as client computing device 100. In the embodiment of FIG. 1, printer 160 includes a processor 170, and a machine-readable storage medium 180. Printer 160 may also include an ink cartridge 190. Ink cartridge 190 may be inserted in printer 160 and may be removed from printer 160 such that an ink cartridge that may be out of ink or otherwise inoperable may be replaced with a new ink cartridge.

Processor 170 may be one or more central processing units (CPUs), microprocessors, and/or other hardware devices suitable for retrieval and execution of instructions stored in machine-readable storage medium 180. Processor 170 may fetch, decode, and execute instructions 181, 182, 183, 184, 185, 186 to identify a source of an ink cartridge, such as ink cartridge 190, as described below. As an alternative or in addition to retrieving and executing instructions 181, 182, 183, 184, 185, 186, processor 170 may include one or more electronic circuits comprising a number of electronic components for performing the functionality of one or more of instructions 181, 182, 183, 184, 185, 186.

Machine-readable storage medium 180 may be any electronic, magnetic, optical, or other physical storage device that stores executable instructions. Thus, machine-readable storage medium 180 may be, for example, Random Access Memory (RAM), an Electrically-Erasable Programmable Read-Only Memory (EEPROM), a storage drive, an optical disc, and the like. As described in detail below, machine-readable storage medium 180 may be encoded with executable instructions 181, 182, 183, 184, 185, 186 for identifying a source of an ink cartridge, such as ink cartridge 190.

Cartridge 190 may include a color pen 196 that is used to print different colors by combining different colors of ink provided from ink chambers 198. Characteristics of color pen 196 may be identified by identification bits stored in cartridge. Example identification bits may include supply source indicator bits 192 and ink order identification bits 194, as described with reference to FIG. 2. Supply source indicator bits 192 may identify a source of ink cartridge 190. Ink order identification bits 194 may identify the different colors of ink that are assigned to ink chambers 198 in color pen 196. Some combinations of ink order identification bits 194 correspond to special ink cartridges such as those provided by a corporate service, and other combinations of ink order identification bits 194 are reserved for regular ink cartridges such as those purchased from a retail outlet.

Client computing device 100 may be, for example, a notebook computer, a desktop computer, an all-in-one system, a thin client, a workstation, a tablet computing device, a mobile phone, or any other computing device suitable for execution of the functionality described below. In FIG. 1, client computing device 100 includes processor 110 and machine-readable storage medium 120.

As with processor 170 of printer 160, processor 110 may be one or more CPUs, microprocessors, and/or other hardware devices suitable for retrieval and execution of instructions 125. Processor 110 may fetch, decode, and execute instructions 125. Processor 110 may also or instead include electronic circuitry for performing the functionality of instructions 125. As with storage medium 180 of printer 160, machine-readable storage medium 120 may be any physical storage device that stores executable instructions.

Communication may be established between client computing device 100 and printer 160. For example, client computing device 100 may access printer 160 at a predetermined Internet Protocol (IP) address and, in response, printer 160 may establish a communication session with client computing device 100. In some implementations, client login credentials, such as a user identifier and a corresponding authentication parameter (e.g., a password), may be used to establish communication with printer 160.

Print data output instructions 125 may output print data to printer 160. The print data may correspond to any type of information that a user desires to have printed by printer 160. The print data may include data corresponding to text, diagrams, and pictures. The print data may include information to be printed on one or more sheets of paper. The print data may be generated by the user at client computing device or may be downloaded from another source such as a web site. The print data may be a form with additional information provided by the user.

Print data receiving instructions 181 may receive the print data from client computing device 100 over network 140, or may receive the print data directly from client computing device 100. Print data receiving instructions 181 may parse the print data to determine how to cause the print data to be output from printer 160. For example, print data receiving instructions 181 may determine which color inks are to be used to print the print data, how many sheets of paper are required to print the print data, and whether the print data includes text, pictures, diagrams or combinations thereof.

Supply source indicator access instructions 182 may access a supply source indicator bit 192 from the color pen identification bits to identify a source of an ink cartridge, such as ink cartridge 190. In some implementations, the supply source indicator bit may indicate that ink cartridge 190 that is provided in printer 160 corresponds to a special ink cartridge that was provided to a user who has subscribed to receive the ink cartridge from a corporate service. In other implementations, the supply source indicator bit may indicate that ink cartridge 190 that is provided in printer 160 corresponds to a regular ink cartridge that was provided to retail outlets for purchase by consumers.

Ink order identifier access instructions 182 may access ink order identifier bits 194 from the identification bits of the color pen to confirm identification of the source of an ink cartridge, such as ink cartridge 190. Ink order identifier bits 194 identify an order in which ink colors are provided in ink chambers 198 of color pen 196. In some implementations, color pen 196 may include three different ink chambers where each chamber corresponds to a different ink color. Ink order identifier bits 194 may indicate which ink color is to be provided in which chamber for a color pen used with special ink cartridges. For example, a first ink order identifier bit may indicate that cyan is to be provided in a first chamber of the color pen, a second ink order identifier bit may indicate that yellow is to be provided in a second chamber of the color pen, and a third ink order identifier bit may indicate that magenta is to be provided in a third chamber of the color pen.

Special ink cartridge support determining instructions 184 may identify whether ink cartridge 190 corresponds to an ink cartridge that is provided from a special source, such as from a corporate service, or from a regular source, such as a retail outlet. The supply source indictor bit that was previously accessed is used to identify the source of the ink cartridge. The supply source indicator bit may indicate that the ink cartridge is not provided to a user in conjunction with a corporate service. In this case, the ink order identifier bits are accessed to identify which colors of ink are provided in each ink chamber of color pen 196. Printing instructions 185 may then cause the print data to be printed using the ink orders identified by the ink order identifier bits, corresponding to the ink order of a regular ink cartridge.

The supply source indicator bit may indicate that the ink cartridge is a special ink cartridge such as an ink cartridge provided by a corporate service. In this case, ink order identification bits 194 are accessed to confirm that the ink cartridge actually is a special ink cartridge. In the event that the accessed ink order identification bits identify the ink cartridge as a special ink cartridge, printing instructions 185 may cause the print data to be printed using the ink order of the color pen chambers as identified by the ink order identification bits. Accordingly, the print data will be correctly printed using the special ink cartridge that may have been provided by a corporate service, and the resulting printed material may appear as intended by the user.

In one example, in an event that the accessed ink order identification bits do not correspond to a special ink cartridge, while the supply source indicator bit indicates that the ink cartridge is a special cartridge, the print data is not printed because the lack of correspondence between the ink order identification bits and the supply source indicator bit indicate that the supply source indicator bit may have been tampered with or otherwise altered. In this example, error message generating instructions 186 may generate an error message that indicates that the print data could not be printed because the ink cartridge provided in the printer is not authenticated as a subscribed special cartridge as per the service contract.

FIG. 2 is a chart including examples of identification bits for a color pen that may be used to identify a source of an ink cartridge. There are many different identification bits that may be associated with a color pen. Example identification bits that may be used to identify a source of an ink cartridge may include ink order identification bits 210 and supply source indicator bits 230. Other entries in the chart that are associated with the identification bits may correspond to color order 220 and firmware status 240.

Rows of the chart provide different combinations of binary ink order identification bits and the corresponding color order that is supported by each combination of the ink order identification bits. Each row also provides a supply source indicator bit and a statement of firmware status. Ink order identification bits 210 and supply source indicator bits 230 may be included with other identification bits for a color pen of the ink cartridge.

Each ink order identification bit 210 may be mapped to a physical ink location in a chamber of a color pen to identify which ink color is to be provided in each chamber. The supply source indicator bit for the ink cartridge identifies a source of the ink cartridge. For example, the supply source indicator bit may identify that the ink cartridge is a special ink cartridge provided from a corporate service or that the cartridge is a regular ink cartridge purchased from a retail outlet.

The combinations of ink order identification bits and the corresponding color orders, supply source indicator bits, and firmware status are provided as illustrative examples. Other combinations may be provided to identify a source of an ink cartridge.

In row 250 of the chart, the ink order identification bit combination is 000 and the corresponding color order is cyan-yellow-magenta. The supply source indicator bit indicates that the ink cartridge is a regular ink cartridge. Accordingly, the firmware status identifies the ink cartridge as a regular supply.

In row 255 of the chart, the ink order identification bit combination is 001 and the corresponding color order is cyan-magenta-yellow. The supply source indicator bit indicates that the ink cartridge is a special supply that may have been provided from a corporate service. Accordingly, the firmware status identifies the ink cartridge as a special supply.

In row 260 of the chart, the ink order identification bit combination is 010 and the corresponding color order is yellow-magenta-cyan. The supply source indicator bit indicates that the ink cartridge is a regular ink cartridge. Accordingly, the firmware status identifies the ink cartridge as a regular supply.

In row 265 of the chart, the ink order identification bit combination is 011 and the corresponding color order is yellow-cyan-magenta. The supply source indicator bit indicates that the ink cartridge is a special ink cartridge. Accordingly, the firmware status identifies the ink cartridge as a special supply.

In row 270 of the chart, the ink order identification bit combination is 100 and the corresponding color order is magenta-yellow-cyan. The supply source indicator bit indicates that the ink cartridge is a regular ink cartridge. Accordingly, the firmware status identifies the ink cartridge as a regular supply.

In row 275 of the chart, the ink order identification bit combination is 101 and the corresponding color order is magenta-cyan-. The supply source indicator bit indicates that the ink cartridge is a regular ink cartridge. Accordingly, the firmware status identifies the ink cartridge as a special supply.

In some implementations, the color order may include other combinations that do not identify all combinations of available ink colors. For example, an ink order identification bit combination for a special ink cartridge may correspond to a color order of yellow-cyan-yellow (as shown in row 280), and a different ink order identification bit combination for a special ink cartridge may correspond to a color order of magenta-cyan-magenta (as shown in row 285). In this case, a printer may be enabled to double its color ink capacity by accessing three different colors from six available ink chambers.

As discussed below, the supply source indicator bits and the ink order identification bits provided in the chart may be assigned to particular types of ink cartridges (special and regular). Before a printer begins printing, the supply source indicator bits and the ink order identification bits are accessed from the identification bits of a color pen to determine whether the ink cartridge is compatible with the printer by identifying the source of the ink cartridge.

Figure 3:
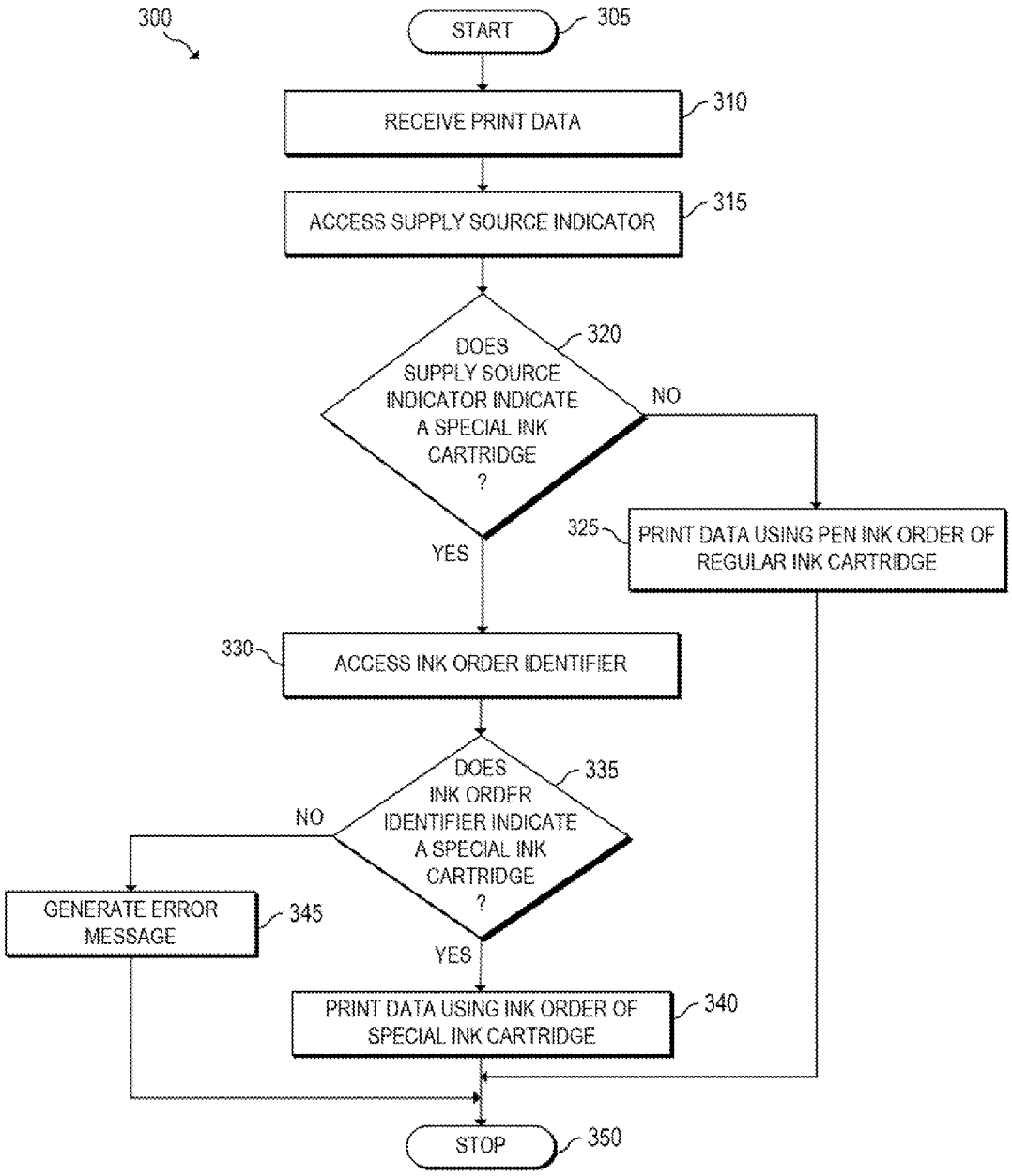
FIG. 3 is a flowchart of an example method for execution by a printer for identifying a source of an ink cartridge.

FIG. 3 is a flowchart of an example method 300 for execution by printer 160 for identifying a source of an ink cartridge. Although execution of method 300 is described below with reference to printer 160 of FIG. 1, other suitable devices for execution of method 300 will be apparent to those of skill in the art. Method 300 may be implemented in the form of executable instructions stored on a machine-readable storage medium, such as storage medium 180, and/or in the form of electronic circuitry.

Method 300 may start in block 305 and continue to block 310, where print data is received at printer 160. The print data may be received directly from a client computing device, such as client computing device 100. In some implementations, the print data may be received from a network, such as network 140. The print data may correspond to any information that may be output as printed material by printer 160.

Next, in block 315, a supply source indicator is accessed from the color pen identification bits. The supply source indicator indicates a source of the ink cartridge provided in printer 160. For example, the supply source indicator may identify the ink cartridge as being a special ink cartridge such as an ink cartridge provided by a corporate service. In another example, the supply source indicator may identify the ink cartridge as being a regular ink cartridge such as an ink cartridge purchased from a retail outlet.

In block 320, a determination is made as to whether the supply source indicator indicates that the ink cartridge is a special ink cartridge. In the event that the supply source indicator indicates that the ink cartridge is not a special ink subscription service, processing proceeds to block 325. In the event that the supply source indicator indicates that the ink cartridge is a special ink cartridge, processing proceeds to block 330.

In block 325, the print data is printed using the ink order of the color pen that is associated with regular ink cartridges. The ink order of the chambers in the color pen corresponds to an ink order identifier that is associated with the supply source indicator. For example, the supply source indicator may indicate that the ink cartridge is not provided to a user by a corporate service, and the corresponding ink order identifier may provide an ink order of cyan-magenta-yellow for the regular ink cartridge. Accordingly, the print data may be printed using cyan for a first chamber in the color pen, magenta for a second chamber in the color pen, and yellow for a third chamber in the color pen, since the color order identifier corresponds to the actual ink colors in the different chambers of the color pen. Method 300 may subsequently proceed to block 350, where method 300 may stop.

In block 330, the ink order identifier is accessed from the color pen identification bits. The ink order identifier may include bits that are mapped to the ink chambers of the color pen to indicate the ink colors that are included in the ink chambers. In some implementations, the color pen includes three ink chambers. Three ink order bits may identify which ink color ink is provided in each of the three chambers. For example, one ink order identification bit may indicate that cyan ink is to be provided in a first chamber, another ink order identification bit may indicate that magenta ink is to be provided in a second chamber, and a further ink order identification bit may indicate that yellow ink is to be provided in a third chamber.

Next, in block 335, a determination is made as to whether the ink order identifier indicates that the ink cartridge is a special ink cartridge. By determining whether the ink order identifier indicates that the ink cartridge is a special ink cartridge, an ink cartridge may be confirmed as being provided to a user from a corporate service. The ink order identifier may be used to confirm that the ink cartridge is actually a special ink cartridge. In the event that the ink order identifier indicates that the ink cartridge is a special ink cartridge, processing continues to block 340. In the event that the ink order identifier indicates that the ink cartridge is not a special ink cartridge, processing continues to block 345.

In block 340, the print data is printed using the color pen ink order identified by the ink order identifier. The resulting printed material will be printed as the user intended because the ink order identifier corresponds to the actual ink colors in the chambers of the color pen. Processing then moves to block 350 where method 300 stops.

In block 345, an error message is generated to indicate that the ink cartridge does not pertain to the subscribed corporate service. For example, the error message may inform a user that the ink cartridge is not authorized for use with the subscribed printer. Processing then continues to block 350 where method 300 ends.

We claim:

1. A method of controlling a print system, the method comprising:

obtaining print data;

accessing a supply source indicator from storage in an ink cartridge, wherein the supply source indicator identifies a source of the ink cartridge;

accessing an ink order identifier from storage in the ink cartridge, wherein the ink order identifier indicates an order in which ink colors are provided in chambers of a color pen of the ink cartridge;

determining whether the ink cartridge corresponds to a subscribed source based on the supply source indicator and the ink order identifier; and in the event that the ink cartridge is determined as corresponding to a subscribed source, causing the print data to be printed using the color pen, wherein the ink order identifier corresponds to the order of the ink colors provided when using the color pen.

2. The method of claim 1, wherein the supply source indicator identifies the ink cartridge as not corresponding to a subscribed source, the method further comprising:

causing the print data to be printed using the color pen, wherein the ink order identifier does not correspond to the order of the ink colors provided in chambers of a color pen of an ink cartridge corresponding to a subscribed source.

3. The method of claim 1, wherein the supply source indicator identifies the ink cartridge as not corresponding to a subscribed source, the method further comprising:

causing the print data to be printed using the color pen, wherein the ink order identifier corresponds to an order of ink colors provided in chambers of a color pen of an ink cartridge corresponding to a non-subscribed source that is different from an order of ink colors provided in chambers of a color pen of an ink cartridge corresponding to a subscribed source.

4. The method of claim 1, further comprising:

generating an error message that indicates that the ink cartridge does not correspond to a subscribed source.

5. The method of claim 1, wherein the supply source indicator comprises a supply source indicator bit, the supply source indicator bit being stored with identification bits of the color pen.

6. The method of claim 1, wherein the ink order identifier comprises ink order identification bits, the ink order identification bits being stored with identification bits of the color pen.

7. The method of claim 1, wherein determining whether the ink cartridge corresponds to a subscribed source comprises determining whether the supply source indicator indicates a special ink cartridge and determining whether the ink order identifier corresponds to a special ink cartridge.

8. A machine-readable storage medium encoded with instructions executable by a processor of a printer, the machine-readable storage medium comprising:

instructions for receiving print data, instructions for accessing a supply source indicator bit from color pen identification bits in an ink cartridge, wherein the supply source indicator bit identifies whether the ink cartridge is provided from a subscribed source, instructions for accessing ink order identifier bits from the color pen identification bits, wherein the ink order identifier bits indicate an order of ink colors provided in chambers of a color pen of the ink cartridge, instructions for determining that the ink cartridge is not received from a subscribed source based on the supply source indicator bit and the ink order identifier bits, and instructions for generating an error message that indicates that the ink cartridge is not received from a subscribed source.

9. The machine-readable storage medium of claim 8, further comprising:

instructions for determining that the ink cartridge is received from a subscribed source based on the supply source indicator bit and the ink order identifier bits, and instructions for causing the print data to be printed using the color pen of the ink cartridge determined as being received from a subscribed source, wherein the ink order identifier bits correspond to the order of the ink colors provided in the chambers of the color pen.

10. The machine-readable storage medium of claim 8, further comprising:

instructions for causing the print data to be printed using the color pen of the ink cartridge determined as not being received from a subscribed source, wherein the ink order identifier bits do not correspond to the order of the ink colors provided in chambers of a color pen of an ink cartridge received from a subscribed source.

11. The machine-readable storage medium of claim 8, further comprising:

instructions for causing the print data to be printed using the color pen of the ink cartridge determined as not being received from a subscribed source, wherein the ink order identifier bits correspond to an order of ink colors provided in chambers of a color pen of an ink cartridge received from a non-subscribed source that is different from an order of ink colors provided in chambers of a color pen of an ink cartridge received from a subscribed source.

12. A printer comprising:

a color pen comprising ink chambers, wherein each ink chamber corresponds to an ink color;

storage comprising a supply source indicator and ink order identifier, wherein the supply source indicator indicates whether an ink cartridge is received from a subscribed source, and the ink order identifier indicates an order in which ink colors are provided in the ink chambers of the color pen; and a processor to:

obtain print data, determine whether the ink cartridge corresponds to a subscribed source based on the supply source indicator and the ink order identifier, and in the event that the ink cartridge does not correspond to a subscribed source, identify the ink cartridge as being not received from a subscribed source.

13. The printer of claim 12, wherein the processor further acts to:

generate an error message that indicates that the ink cartridge is not received from a subscribed source.

14. The printer of claim 12, wherein the processor further acts to:

determine that the ink cartridge corresponds to a subscriber source based on the supply source indicator and the ink order identifier, and cause the print data to be printed using the color pen of the ink cartridge determined as corresponding to a subscribed source, wherein the ink order identifier corresponds to the order of the ink colors provided in ink chambers of a color pen of an ink cartridge corresponding to a subscribed source.

15. The printer of claim 12, wherein the processor further acts to:

determine that the ink cartridge corresponds to a non-subscriber source based on the supply source indicator and the ink order identifier, and cause the print data to be printed using the color pen of the ink cartridge determined as corresponding to a non-subscribed source, wherein the ink order identifier does not correspond to an order of ink colors provided ink chambers of a color pen of an ink cartridge corresponding to a subscribed source.

16. The printer of claim 12, wherein the processor further acts to:

determine that the ink cartridge corresponds to a non-subscriber source based on the supply source indicator and the ink order identifier, and cause the print data to be printed using the color pen of the ink cartridge determined as corresponding to a non-subscribed source, wherein the ink order identifier corresponds to an order of ink colors provided in ink chambers of a color pen of an ink cartridge corresponding to a non-subscribed source that is different from the order of ink colors provided in ink chambers a color pen of an ink cartridge corresponding to a subscribed source.

17. The printer of claim 12, wherein the color pen and the storage including the supply source indicator and the ink order identifier are components of the ink cartridge.

18. An ink cartridge comprising:

a color pen including a plurality of ink chambers, wherein each ink chamber corresponds to an ink color; and storage that stores a supply source indicator and an ink order identifier, wherein the supply source indicator indicates whether an ink cartridge is from a subscribed source, and the ink order identifier indicates an order in which ink colors are provided in the ink chambers of the color pen.

19. The ink cartridge of claim 18, wherein values of the supply source indicator and the ink order identifier are related in a manner that permits determination that the ink cartridge is not authentic for an ink cartridge from a subscribed source.

* * * * *